US006129024A

United States Patent [19]

Gerber et al.

[11] Patent Number: 6,129,024

[45] Date of Patent: Oct. 10, 2000

[54] PROJECTILE WITH A PROGRAMMABLE TIME FUSE

[75] Inventors: Michael Gerber, Zurich; Peter Ettmueller, Bachenbuelach, both of Switzerland

[73] Assignee: Oerlikon Contraves AG, Zeurich, Switzerland

[21] Appl. No.: 09/196,381

[22] Filed: Nov. 19, 1998

[30] Foreign Application Priority Data

Nov. 19, 1997 [CH] Switzerland ..... 2670/97

[51] Int. Cl.[7] ..... F42B 14/06

[52] U.S. Cl. ..... 102/521

[58] Field of Search ..... 102/520, 521, 102/522, 523, 494, 495, 496, 499, 430, 517; 89/6.5

[56] References Cited

U.S. PATENT DOCUMENTS

| | | | |
|---|---|---|---|
| 4,022,102 | 5/1977 | Ettel . | |
| 4,036,140 | 7/1977 | Korr et al. . | |
| 4,649,796 | 3/1987 | Schmidt | 89/6.5 |
| 4,770,101 | 9/1988 | Robertson et al. . | |
| 4,846,072 | 7/1989 | Rossmann | 102/520 |
| 4,970,960 | 11/1990 | Feldmann . | |
| 5,265,539 | 11/1993 | Kurschner et al. . | |
| 5,817,969 | 10/1998 | Ettmuller | 102/489 |
| 5,864,086 | 1/1999 | Ettmuller | 102/489 |

FOREIGN PATENT DOCUMENTS

| | | |
|---|---|---|
| 118122 | 5/1987 | European Pat. Off. . |
| 253058 | 1/1988 | European Pat. Off. . |
| 3016638 | 1/1991 | Germany . |
| 3617415 | 5/1992 | Germany . |
| 3443534 | 3/1995 | Germany . |

OTHER PUBLICATIONS

Pamphlet–OC2076e *The Evolution and Design of an Advanced Hit Efficiency and Destruction 35 mm Ammunition.*

Pamphlet OC204le *the lethal blow to any missile or other airborne threat.*

Pamphlet OC2057d *Products and Activities.*

*Primary Examiner*—Thomas Price

*Attorney, Agent, or Firm*—Townsend and Townsend and Crew LLP; Guy W. Chambers, Esq.

[57] ABSTRACT

In connection with a projectile, the effective substance (4) is designed as a projectile core (3), which is held in place by a propulsion reflector sheath (1) and a propulsion reflector back (2). The data reception coil (13) and the power supply (14) are arranged in the propulsion reflection back (2), while the remaining elements (9, 10, 11, 12) of the programmable time fuse (8) are installed in the projectile core (3, 25). Predetermined breaking points are provided in the propulsion reflector sheath (1) and the propulsion reflector back (2), so that following the firing of the projectile, the propulsion reflector sheath (1) and the propulsion reflector back (2) with the data reception coil (13) and the power supply (14) are separated, and only the projectile core (3) with the remaining elements (9, 10, 11, 12) of the programmable time fuse (8) alone continue to travel.

9 Claims, 3 Drawing Sheets

PROJECTILE WITH A PROGRAMMABLE TIME FUSE

FIELD OF THE INVENTION

The invention relates to a projectile with a programmable time fuse having at least one data reception coil and a power supply, as well as an effective substance, which is disaggregated, or respectively ejected, at the end of a programmed fuse setting time.

BACKGROUND OF THE INVENTION

Such a projectile has become known in connection with an application in a missile defense system from the pamphlets OC 2076e, OC 2041e, OC 2057d and others of the Oerlikon Contraves company of Zürich, Switzerland. With such defense systems, an incoming target is detected by means of a fire control device, tracked, and a gun automatically follows it. In the process, calculations of the travel time of the projectile are performed, and at the time of firing the updated fuse setting time is inductively transmitted to the time fuse of each projectile by means of a programming coil located at the mouth of the barrel. By means of the ejection of the effective substance, for example in the form of sub-projectiles, by means of igniting an ejection charge is assured at an optimal time directly in front of the incoming target.

Such a projectile consists of a projectile body, to the front of which a ballistic shroud and to the back of which a fuse housing are attached. A programmable time fuse is provided in the fuse housing, which consists of a data reception coil, and power supply with a surge generator, an electronic time fuse module, a fuse, a detonator and an ejection charge. A space for the effective substance is provided in the projectile body between the shroud and the fuse housing, in which an effective substance in the form of sub-projectiles is arranged, fixed against relative rotation. A holding screw keeps the effective substance fixed in the axial direction and connects the projectile body with the shroud.

A high probability of destruction is achieved with projectiles of this type up to a useful distance of approximately three kilometers. But this drops rapidly thereafter, because of the slowing speed of the projectiles.

OBJECT AND SUMMARY OF THE INVENTION

It is therefore the object of the invention to propose such a projectile, which can be employed over greater distances and has a higher probability of destruction.

This object is attained by means of the invention recited in claim 1. In this case the effective substance is embodied as the projectile core, which is held in place by a propulsion reflector sheath and a propulsion reflector back. The data reception coil and the power supply are arranged in the propulsion reflector back, while the remaining elements of the programmable time fuse are installed in the projectile core. Predetermined breaking points are provided in the propulsion reflector sheath and the propulsion reflector back, so that following the firing of the projectile, the propulsion reflector sheath and the propulsion reflector back with the data reception coil and the power supply are separated and only the projectile core with the remaining elements of the programmable time fuse alone continues the flight.

The advantages which can be achieved by means of the invention lie in that with this projectile the defense system described at the outset can also be used over greater distances, and a defense against aircraft and helicopters is made possible over a range of approximately up to five kilometers. Shorter travel times and a greater probability of destruction of armored targets in particular are achieved. Although the probability of a hit is less because of the low number of sub-projectiles in the proposed variant of the embodiment, this is compensated by the considerably reduced travel time.

The invention will be explained in more detail in what follows by means of several exemplary embodiments in connection with the drawings.

DETAILED DESCRIPTION OF THE PREFERRED EMBODIMENTS

Figure 1:
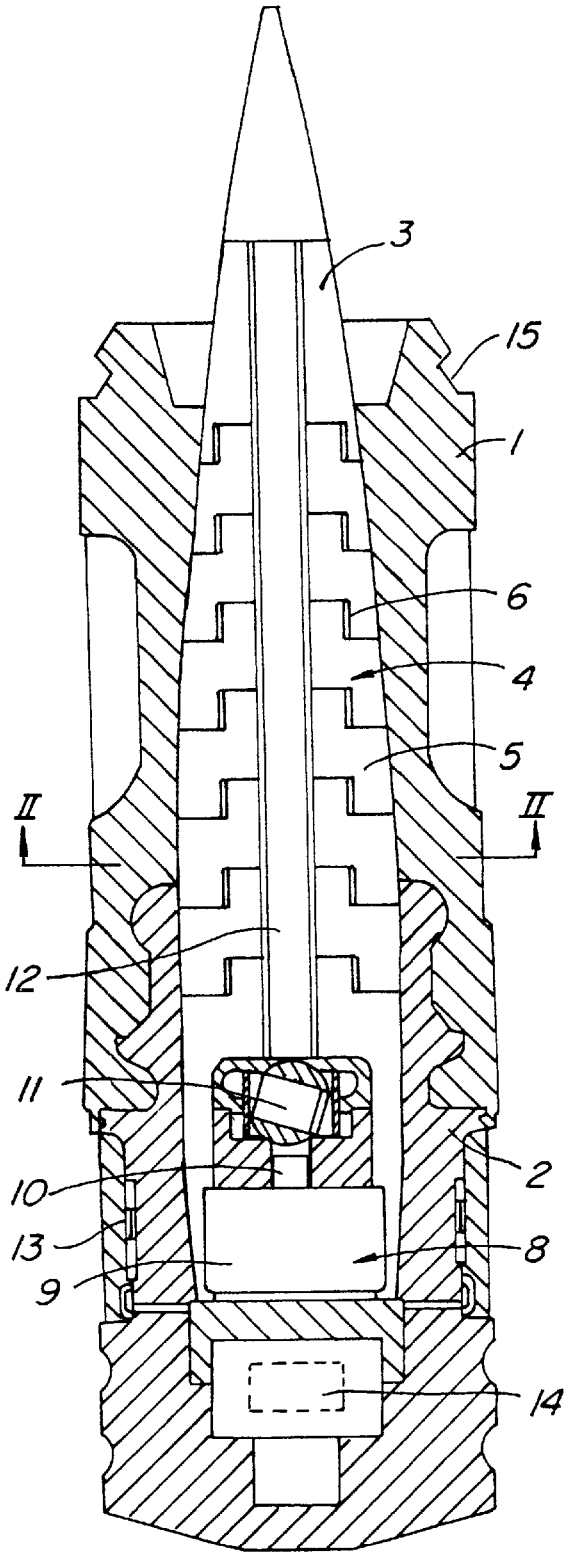
FIG. 1 represents a longitudinal section through a first embodiment of the projectile in accordance with the invention.
Figure 2:
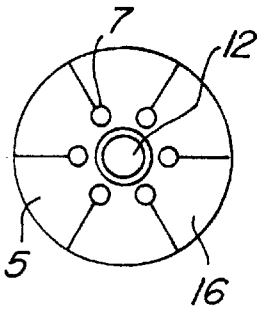
FIG. 2 is a cross section of a projectile core of the projectile along the line II—II in FIG. 1.
Figure 2A:
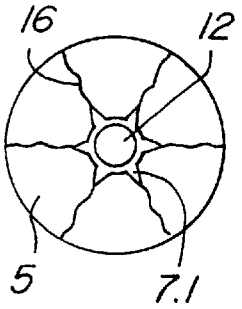
FIG. 2*a* is a cross section of the projectile core of the projectile in a variation of the first embodiment along the line II—II in FIG. 1.

A propulsion reflector sheath is identified by 1 in FIGS. 1, 2, and 2*a*, and by 2 a propulsion reflector back, which is fixedly connected with the propulsion reflector sheath 1. A projectile core 3, which is composed of an effective substance 4, is maintained in the propulsion reflector sheath 1 and the propulsion reflector back 2. The effective substance 4 consists of lined-up, metallic, disk-shaped bodies 5 having threaded shoulders 6, by means of which they are screwed to each other. Bores 7 have been provided in the bodies 5, which are evenly distributed on a partial circle located concentrically in respect to the center axis of the bodies 5, or respectively of the projectile. Pre-fragmentation of the the bodies 5 is achieved by means of the bores 7, by which the size of the fragments can be affected. A programmable time fuse 8 is installed in the projectile core 3, which consists of an electronic time fuse module 9, an electrical firing cap 10, a detonator 11 and a detonator bore 12. A data reception coil 13, which is also a part of the time fuse 8, as well as a power supply in the form of a surge generator 14 are arranged in the propulsion reflector back 2. A circumferential groove is identified by 15, which is used for fastening a protective shroud, not represented, on the propulsion reflector sheath 1. As known per se, predetermined breaking points, not shown in detail, are provided, so that following the firing of the projectile, the propulsion reflector sheath 1 and the propulsion reflector back 2 with the data reception coil 13 and the surge generator 14 are separated, and the projectile core 3 with the installed time fuse elements 9, 10, 11 and 12 alone continues to travel. At the end of the fuse setting time, or respectively disaggregation time, which was set in the time fuse 8 and inductively transmitted to the data reception coil 13 at the time of firing, the projectile body 3 is disaggregated through the detonator bore 12. Predetermined breaking points provided in the disk-shaped bodies 5 are identified by 16. In place of bores 7, it is also possible to use notches 7.1, represented in FIG. 2*a*.

Figure 3:
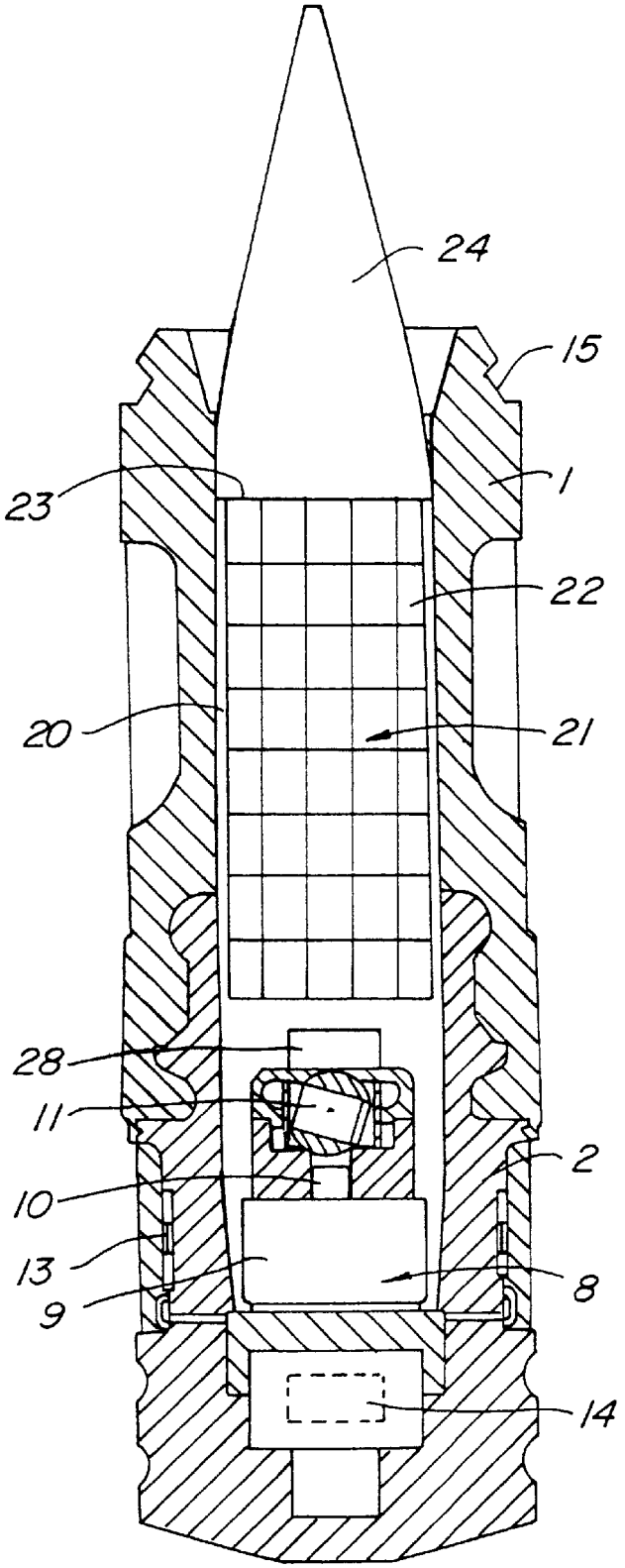
FIG. 3 is a cross section of the projectile in a second embodiment.

In accordance with FIG. 3, an effective substance 21 arranged in a projectile body 20 consists of a plurality of sub-projectiles 22 of a heavy metal having, for example, a cylindrical shape. The sub-projectiles 22 are combined into sub-projectile columns 23 extending parallel in the longitudinal direction of the projectile and are held, not further represented, fixed against relative rotation and in the longitudinal direction, in the projectile body 20. A projectile tip connected with the projectile body is indicated by 24.

Figure 4:
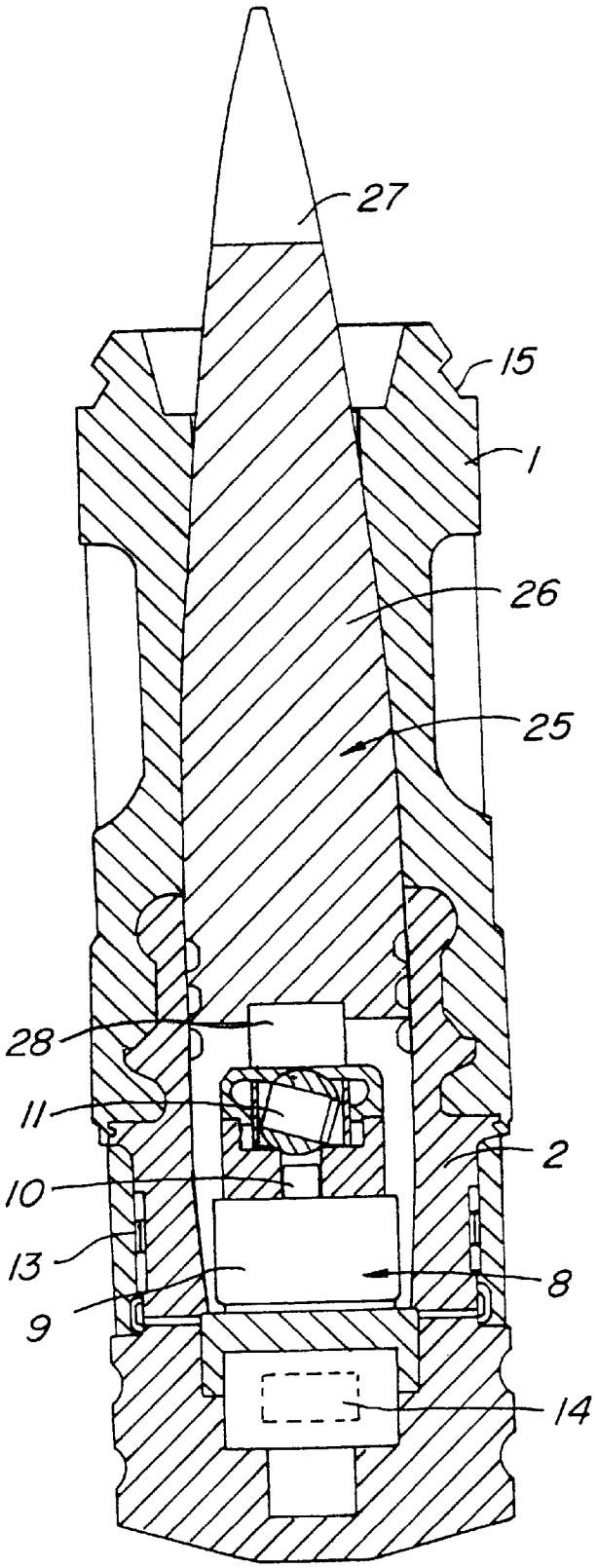
FIG. 4 is a cross section of the projectile in a third embodiment.

In accordance with FIG. 4, an effective substance 26, designed as a projectile core 25 with a projectile tip 27, consists of a frangible heavy metal.

An ejection charge is identified by 28 in FIGS. 3 and 4, which is used in place of the detonator bore 12 of the embodiment in accordance with FIGS. 1, 2 and 2*a*.

In place of the sub-projectile columns 23 it is also possible to use arrows. It is also possible to design the projectile core as an arrow.

List Reference Numerals

1 Propulsion reflector sheath
2 Propulsion reflector back
3 Projectile core
4 Effective substance
5 Body
6 Threaded shoulders
7 Bores
7.1 Notches
8 Programmable time fuse
9 Electronic time fuse module
10 Electrical firing cap
11 Detonator
12 Detonator bore
13 Data reception coil
14 Surge generator
15 Circumferential groove
16 Predetermined breaking point
20 Projectile body
21 Effective substance
22 Sub-projectile
23 Sub-projectile column
24 Projectile tip
25 Projectile core
26 Effective substance
27 Projectile tip
28 Ejection charge

What is claimed is:

1. A projectile with a programmable time fuse having at least one data reception coil and a power supply, as well as an effective substance, which is disaggregated, or respectively ejected, at the end of a programmed fuse setting time, the improvement comprising the effective substance is designed as a projectile core, which is held in place by a propulsion reflector sheath and a propulsion reflector back, the data reception coil and the power supply are arranged in the propulsion reflection rear, while the remaining elements of the programmable time fuse are installed in the projectile core, and predetermined breaking points are provided in the propulsion reflector sheath and the propulsion reflector back, so that following the firing of the projectile, the propulsion reflector sheath and the propulsion reflector back with the data reception coil and the power supply are separated, and only the projectile core with the remaining elements of the programmable time fuse continue to travel.

2. A projectile in accordance with claim 1, wherein the effective substance consists of lined-up, metallic, disk-shaped bodies, which are prefragmented for a defined fragment size.

3. A projectile in accordance with claim 2, wherein bores or notches have been provided in the bodies for the purpose of prefragmentation.

4. A projectile in accordance with claim 1, wherein the effective substance consists of a frangible heavy metal.

5. A projectile in accordance with claim 1, wherein the projectile core is designed as an arrow.

6. A projectile with a programmable time fuse having at least one data reception coil and a power supply, as well as an effective substance, which is ejected at the end of a programmed fuse setting time, the improvement comprising the effective substance is arranged in a projectile core, which is held in place by a propulsion reflector sheath and a propulsion reflector back, the data reception coil and the power supply are arranged in the propulsion reflection back, while the remaining elements of the programmable time fuse are installed in the projectile core, and predetermined breaking points are provided in the propulsion reflector sheath and the propulsion reflector back, so that following the firing of the projectile, the propulsion reflector sheath and the propulsion reflector back with the data reception coil and the power supply are separated, and only the projectile core with the remaining elements of the programmable time fuse continue to travel.

7. A projectile in accordance with claim 6, wherein the effective substance consists of a plurality of sub-projectiles made of a heavy metal.

8. A projectile in accordance with claim 7, wherein the sub-projectiles have a cylindrical shape and are combined into sub-projectile columns, extending in the longitudinal direction of the projectile.

9. A projectile in accordance with claim 8, wherein arrows are used in place of the sub-projectile columns.

* * * * *